US005481351A

United States Patent [19]

Kawai et al.

[11] Patent Number: 5,481,351

[45] Date of Patent: Jan. 2, 1996

[54] ELECTROPHOTOGRAPHIC RECORDING APPARATUS HAVING IMPROVED RESIDUAL TONER CLEANING FUNCTION

[75] Inventors: Katsuya Kawai; Masayasu Anzai; Toshimitsu Harada; Shinichi Nishino, all of Ibaraki, Japan

[73] Assignee: Hitachi Koki Co., Ltd., Tokyo, Japan

[21] Appl. No.: 214,220

[22] Filed: Mar. 17, 1994

[30] Foreign Application Priority Data

Mar. 18, 1993 [JP] Japan ..... 5-058739
Apr. 19, 1993 [JP] Japan ..... 5-091340

[51] Int. Cl.[6] ..... G03G 21/00

[52] U.S. Cl. ..... 355/298; 355/301; 355/303

[58] Field of Search ..... 355/298, 303, 355/301, 304, 302, 296, 219; 118/652; 209/300, 288

[56] References Cited

U.S. PATENT DOCUMENTS

| | | | |
|---|---|---|---|
| 3,752,576 | 8/1973 | Gerbasi | 355/303 X |
| 4,054,381 | 10/1977 | Bernhard | 355/302 |
| 4,319,832 | 3/1982 | Sakamoto et al. | 355/303 |
| 4,389,968 | 6/1983 | Satomura | 118/652 |
| 4,752,805 | 6/1988 | Fukae et al. | 118/652 X |
| 4,870,465 | 9/1989 | Lindblad et al. | 355/296 |
| 5,200,788 | 4/1993 | Thayer | 355/298 |
| 5,233,398 | 8/1993 | Nimura et al. | 355/303 X |
| 5,341,201 | 8/1994 | Kedarnath et al. | 355/302 |
| 5,430,527 | 7/1995 | Maruyama et al. | 355/296 X |

FOREIGN PATENT DOCUMENTS

| | | | |
|---|---|---|---|
| 3234799 | 5/1983 | Germany . | |
| 3811182 | 10/1988 | Germany . | |
| 55-33075 | 8/1980 | Japan . | |
| 60-22172 | 2/1985 | Japan . | |
| 60-86582 | 5/1985 | Japan | 355/303 |
| 63-15278 | 1/1988 | Japan . | |
| 63-249186 | 10/1988 | Japan | 355/303 |
| 2-51187 | 2/1990 | Japan | 355/303 |
| 3-9384 | 1/1991 | Japan . | |

*Primary Examiner*—A. T. Grimley
*Assistant Examiner*—Shuk Y. Lee
*Attorney, Agent, or Firm*—Sughrue, Mion, Zinn, Macpeak & Seas

[57] ABSTRACT

In an electrophotograpic recording apparatus, a charge supply unit and a light erasing unit are disposed in the stated order when viewed in the direction in which a photoreceptor rotates, at a location between a transfer unit and a bias cleaning unit, and light from the light erasing unit is projected onto a photoreceptor surface area except the charge supplied area. A developing apparatus of the type in which a cleaner section for removing and collecting residual toner on a photoreceptor is coupled through a toner transport pipe with a toner hopper of a developing unit, wherein a meshed foreign material collector, which may be vibrated, is disposed at a location in a residual toner collecting path ranging from the cleaner section, the toner transport pipe, and the toner hopper.

6 Claims, 11 Drawing Sheets

ELECTROPHOTOGRAPHIC RECORDING APPARATUS HAVING IMPROVED RESIDUAL TONER CLEANING FUNCTION

BACKGROUND OF THE INVENTION

1. Field of the Invention

The present invention relates to an electrophotograpic recording apparatus based on the electrophotography technique and an electrostatic recording apparatus, and more particularly to a developing apparatus for use in such apparatus.

2. Discussion of the Related Art

In the field of the electrophotograpic recording apparatus, a typically known residual toner cleaning method for removing toner left on the surface of a photoreceptor after the known charging, exposure, developing and transfer steps is a bias cleaning method for removing the residual toner in a manner such that a conductive cleaning member charged by the charge of the polarity opposite to that of the charge of the residual toner is passed over the residual toner carrying surface of the photoreceptor. In the bias cleaning method, the residual toner is removed from the photoreceptor surface by an electrostatic force. Accordingly, the cleaning function depends largely on a charge state of the residual toner. Toner of the opposite polarities and non-charged toner are contained in the residual toner on the photoreceptor surface.

Japanese Patent Unexamined Publication No. Sho. 63-15278 discloses an improved residual toner cleaning technique which uniformly charges the residual toner on the photoreceptor surface by a DC charging unit immediately before a conductive cleaning brush is passed over the photoreceptor, thereby providing an improved cleaning effect. Japanese Patent Examined Publication No. Sho. 55-33075 discloses another technique for providing an easy separation of the residual toner from a light source lamp by weakening the attaching force of the residual toner to the photoreceptor. This technique uses a charge-removal charger and a light source lamp. The light source lamp projects light on a surface area including a discharge area by the charge-removal charger and an area outside the discharge area, simultaneously with the discharging by the charger.

The technique using a charge supply unit, such as a DC charger for improving the function of cleaning the surface of the photoreceptor is known. Where the residual toner is charged by the charging unit, if the quantity of charge is excessive, the attaching force of the residual toner to the surface of the photoreceptor becomes strong. This deteriorates the cleaning function. Further, the voltage of the photoreceptor after the cleaning operation is nonuniform. This nonuniform voltage becomes problematic in the subsequent charging operation.

A tendency of the influence of the current that is fed to the photoreceptor by the charge supply unit (this current is referred to as "fed-in current" hereinafter) upon the cleaning function depends on a charged state of the residual toner. The residual toner may be categorized into the following four types according to the process of forming the residual toner.

1) A toner image was normally transferred to the photoreceptor, but part of the toner layer forming the toner image remains attached to the surface of the photoreceptor (This residual toner is referred to as "normal residual toner".).

2) Another type of toner is the toner having attached to the surface of the photoreceptor in the form of fog, and referred to as "fog residual toner". This toner is different from the toner of the toner image.

3) Still another type of residual toner is such a toner that fails to touch a recording paper owing to jam trouble or a cut-off of a recording paper, and directly receives charge from the transfer unit. This type of toner is referred to as "jam residual toner".

4). Because of improper power supply to the transfer unit, toner is not transferred to the paper, and left on the photoreceptor (This type of toner is referred to as "power supply failure residual toner".).

Thus, the residual toner having different characteristics are present on the surface of the photoreceptor. Therefore, a value of the fed-in current must be kept within a proper range.

In the bias cleaning method, the friction width of the conductive cleaning member and the photoreceptor influences the cleaning function to remove the residual toner from the surface of the photoreceptor and the lifetime of the photoreceptor. If the friction width is outside the proper range, the cleaning efficiency is reduced and the lifetime of the photoreceptor is reduced owing to the abrasion of the photoreceptor.

Further, in the bias cleaning method, the resistance value of the conductive cleaning member influences the cleaning function. The resistance that conductive cleaning member exhibits when the conductive cleaning member stands still with respect to the photoreceptor or the collecting roller, is different from that when it is moving with respect to the same. A matter of significance for the cleaning function is the resistance of the conductive cleaning member when it is moving. The cleaning efficiency for residual toner removal varies depending on this dynamic resistance. The resistance of the conductive cleaning member is also sensitive to a value of the voltage applied to the conductive cleaning member and a state of the contact of the conductive cleaning member with the collecting roller. Therefore, to keep a high cleaning efficiency, it is important to know a resistance of the conductive cleaning member measured under the same condition as in the process of cleaning the photoreceptor. In the electrophotograpic recording apparatus, however, the measurement of the resistance of the conductive cleaning member is usually carried out when it is manufactured or when the cleaning operation is not carried out. Thus, a proper value of the conductive cleaning member during the process of cleaning has not been obtained.

By the way, it is a common practice that the toner collected by the cleaner is thrown away as waste matter or returned as it is to the developing unit.

In recycling the collected toner, paper pieces, fibers of paper, paper particles, dust and other foreign materials that are contained in the toner are problematic.

A technique to remove foreign materials mixed into the toner is disclosed in Japanese Patent Unexamined Publication No. Hei. 3-9384. In the disclosed technique, a net plate is used for a foreign material removing unit. The mesh size of the net is set to be smaller than the gap between the doctor blade and the magnet roll. Foreign materials larger than the mesh size are paper pieces. Therefore, the technique is constructed not taking account of the foreign materials smaller than the mesh size.

The conventional toner recycle mechanism cannot remove minute foreign materials mixed into toner, such as fibers and paper particles. Accordingly, the toner containing minute foreign materials thereinto is used for development. The result is deterioration of print quality owing to reduction of charge quantity in the developer, clogging in the developing unit or defective image caused by foreign materials cohering together, reduction of fluidity of developer, and the like.

An attempt for further reducing the mesh size to catch minute foreign materials creates another problem. A net having such a small mesh size as to block minute foreign materials also blocks the toner.

SUMMARY OF THE INVENTION

Accordingly, an object of the present invention is to improve the cleaning efficiency and to elongate the cleaning function lasting time (lifetime).

Another object of the present invention is to optimize the fed-in current, and the friction width of the conductive cleaning member and the photoreceptor and the resistance of the conductive cleaning member during the cleaning operation.

Still another object of the present invention is to provide a developing apparatus which can solve the problems, such as print quality deterioration, clogging, image defects, and reduction of fluidity of developer, by removing foreign materials, such as paper pieces and particles, fibers, and dust.

To achieve the above objects, there is provided a electrophotograpic recording apparatus having a transfer unit for transferring a toner image on the photoreceptor onto an image receiving means, and a bias cleaning unit including a conductive cleaning member applied with a voltage for removing toner left on the surface of the photoreceptor and a collecting roller for collecting toner attached to the conductive cleaning member, said roller being applied with a high voltage from the conductive cleaning member, in which a charge supply unit for supplying charge to the surface of the photoreceptor and a light erasing unit for projecting light onto the surface of the photoreceptor are disposed between the transfer unit and the bias cleaning unit in this order when viewed in the direction of the photoreceptor rotation, and the light erasing unit project erasing light onto a photoreceptor surface area except the charge supplied area.

In the electrophotograpic recording apparatus, the absolute value of a DC component of a current that is fed to the photoreceptor by the charge supply unit is 0.01 to 0.2 $\mu C/cm^2$. The friction width of the conductive cleaning member and the photoreceptor during the process of cleaning the photoreceptor is 5 to 20 mm. A value resulting from dividing a resistance value between the conductive cleaning member and the collecting roller during the process of cleaning the photoreceptor by the friction width is 0.003 to 2 $M\Omega/cm^2$.

The electrophotograpic recording apparatus thus constructed and operated under the above-mentioned conditions removes the residual toner through the following process.

1) A toner image is transferred from the photoreceptor to a paper by the transfer unit. The toner which fails in the transfer to the paper during the image transfer process is left as residual toner on the surface of the photoreceptor.

2) Prior to the bias cleaning, the charge supply unit supplies charge to the residual toner. By the charge supply, the charge of the residual toner is set in one polarity. In other words, the toner charged in the opposite polarity and the toner not charged are removed.

3) The light erasing unit projects light a surface area except the area receiving the charge from the charge supply unit. As a result, the attaching force of the residual toner to the photoreceptor is weakened.

4) The residual toner passes the charge supply unit and the light erasing unit, and reaches the conductive cleaning member. At the location of the conductive cleaning member, the residual toner is removed by a mechanical force of the rotation of the conductive cleaning member and the electrostatic attracting force by the voltage applied to the conductive cleaning member.

Further, the above object is achieved by such a technical idea that a foreign material collector has such a mesh size as to be larger than the sizes of foreign materials, such as fibers and paper particles, but to allow the pass of toner is provided, and is vibrated in a state that a part or the whole of the foreign material collector is disposed in toner or developer.

The foreign materials are removed from the toner by the foreign material collector thus constructed. The clean toner is supplied to the developing unit.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

The present invention will be described with reference to the accompanying drawings.

Figure 1:
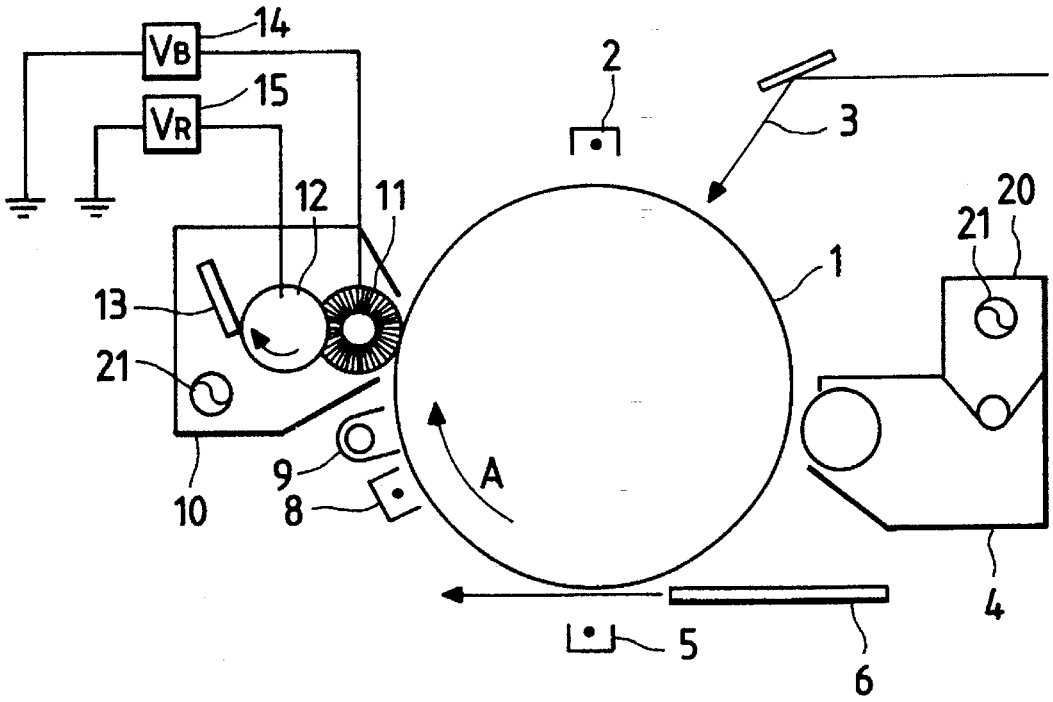
FIG. 1 is a longitudinal sectional view showing an electrophotographic recording apparatus according to an embodiment of the present invention.

FIG. 1 is a longitudinal sectional view showing an electrophotographic recording apparatus according to an embodiment of the present invention. Disposed around a photoreceptor 1 which is rotated in the direction of an arrow A, are a charger 2, an exposure unit 3, a developing unit 4, a transfer unit 5, a charge supply unit 8, a light erasing unit 9, and a bias cleaning unit 10, in the stated order.

The operation of the electrophotograpic recording apparatus thus constructed will be described.

The charger 2 uniformly charges the surface of the photoreceptor 1, and the exposure unit 3 forms a latent electrostatic image thereon by exposure. The latent electrostatic image, when passing the developing unit 4, is visualized by negatively charged toner into a toner image. The transfer unit 5 applies positive charges onto the reverse side of a paper 6 transported from a paper supply unit (not shown) so that the toner image is transferred from the photoreceptor 1 onto the face side of the paper 6. The toner which has not been transferred to the paper 6 is left as a residual toner on the surface of the photoreceptor 1. Usually, most of the residual toner after having been subjected to the transfer process is charged negatively. The charge supply unit 8 feeds a current of preferably −0.02 to −0.1 $\mu C/cm^2$ to the residual toner so that the current charges the residual toner negatively. Outside the charge supply area of the charge supply unit 8, the light erasing unit 9 projects light of 2 to 10 $\mu W/mm^2$ onto the photoreceptor surface bearing the residual toner. Thereafter, the surface of the photoreceptor 1 is made clean by a conductive cleaning member 11, which is applied with a bias voltage of +300 to +1000 V, opposite in polarity to the toner, from a power source 14.

The toner attached to the conductive cleaning member 11 moves toward a collecting roller 12 applied with a bias voltage of +500 to +1500 V, higher than the bias voltage applied to the conductive cleaning member 11, from a power source 15. Thereafter, the toner on the collecting roller 12 is scraped off with a blade 13 and collected into a bias cleaning unit 10. The collected toner is discharged out of the bias cleaning unit 10 by a screw 21, and transferred to a toner hopper 20, which supplies the received toner as fresh toner for reuse.

In this embodiment, the conductive cleaning member 11 takes the form of a brush. The brush is specified as follows: the bristles are 4 to 6 denier thick and 2 to 10 mm long, and made of resin of acetate or polyamide containing carbon or carbon layers. The outer diameter of the brush is 20 to 40 mm, and the axial length thereof is 200 to 500 mm. A sponge like member in lieu of the brush may be used for the conductive cleaning member 11.

Insulating material, such as SUS or an aluminum member with the alumite treated surface, as well as the conductive material may be used for the collecting roller 12.

Figure 3:
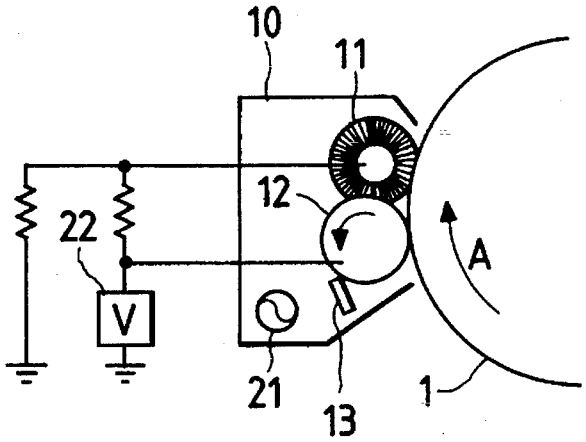
FIG. 3 is a sectional view showing another embodiment of a bias cleaning unit according to the present invention.
Figure 2A:
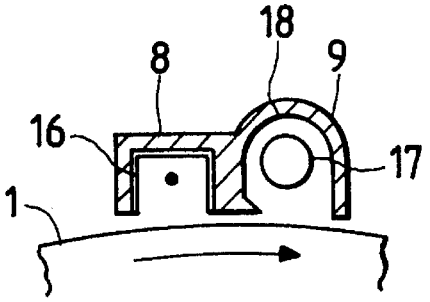
FIGS. 2(*a*), 2(*b*), 2(*c*), 2(*d*), and 2(*e*) are cross sectional views showing the charge supply unit and the light erasing unit according to the embodiments of the present invention.
Figure 2B:
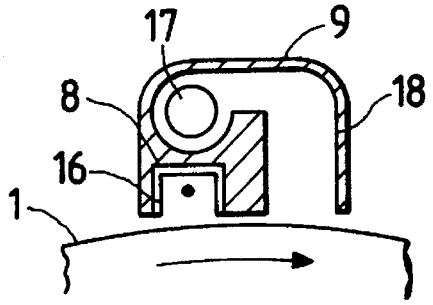
Figure 2C:
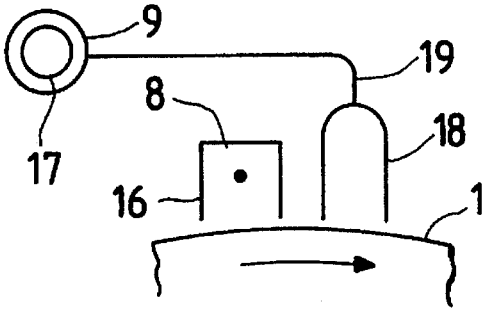
Figure 2D:
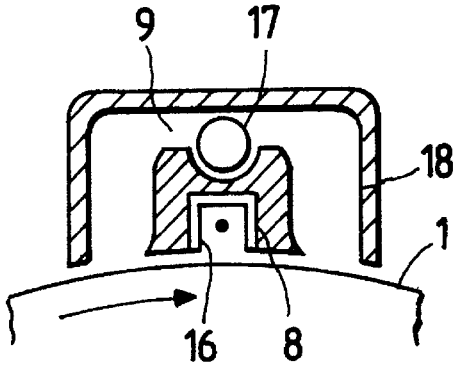
Figure 2E:
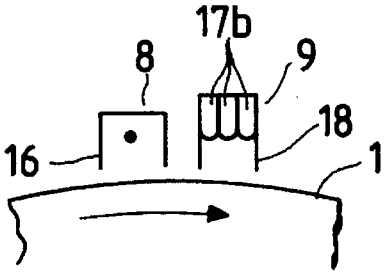

This embodiment uses two separate power sources 14 and 15 for applying the bias voltage to the conductive cleaning member 11 and the collecting roller 12. A single power source 22 may be commonly used as shown in FIG. 3 if an electrical connection is made such that a high bias voltage is applied to the collecting roller 12 from the conductive cleaning member 11.

In the embodiment, the polarity of charge applied from the charge supply unit 8 is the same as that of the residual toner. The polarity of the former may be opposite to that of the latter. In this case, the polarity of the bias voltage applied to the conductive cleaning member 11 and the collecting roller 12 is opposite to that in the above case. In a case where the collected toner is used again for development, the polarity of the charge applied by the charge supply unit 8 is preferably set to be the same as of the residual toner. The reason for this is that the previous charging of the toner reduces the charging time of toner in the developing unit 4. The DC power for driving the charge supply unit 8, may be replaced by the electric power resulting from superposing the AC power on the DC power. In this case, the DC component must satisfy the above conditions.

FIGS. 2(*a*) to 2(*e*) are cross sectional views showing the charge supply unit and the light erasing unit 9 according to embodiments of the present invention. In the instance of FIG. 2(*a*), the charge supply unit 8 and the light erasing unit 9, arrayed side by side, are assembled into a single mold. In the figure, reference numeral 16 designates a shield plate; 17, a tubular lamp as a light source; and 18, a shield plate.

In the instance of FIG. 2(*b*), the light erasing unit 9 is disposed on the rear side of the charge supply unit 8. The inner side of the shield plate 18 is used as a reflecting surface. Light reflected by the reflecting surface is directed to the photoreceptor 1.

In the instance of FIG. 2(*c*), the light erasing unit 9 is disposed at a location apart from the photoreceptor 1. Light from the lamp 17 is led through a suitable unit, for example, an optical fiber 19, to the surface of the photoreceptor 1 after it passes the charge supply unit 8.

In the instance of FIG. 2(*d*), the light erasing unit 9 is disposed on the rear side of the charge supply unit 8, as in the instance of FIG. 2(*b*). Light from the light erasing unit 9 is projected onto the surface of the photoreceptor 1 on both sides of the charge supply unit 8. This instance of the arrangement of the charge supply unit 8 and the light erasing unit 9 may be modified such that two light sources, contained in one or two molds, are disposed on both sides of the charge supply unit 8. Light from those light sources is directly projected to the surface of the photoreceptor 1, as in the instance of FIG. 2(*a*).

The instance of FIG. 2(*e*) uses a light emission diode 17*b* for the light erasing unit 9.

It is evident that any other light source other than the tubular lamp 17 may be used for the light erasing unit 9 in the instances of FIGS. 2(*a*) to 2(*d*), as in the instance of FIG. 2(*e*) using the light emission diode 17*b*. While the charger of the corotron type is used for the charge supply unit 8 in the embodiments shown in FIGS. 1 and 2, a use of the charger of the scorotron type is more preferable.

Figure 7:
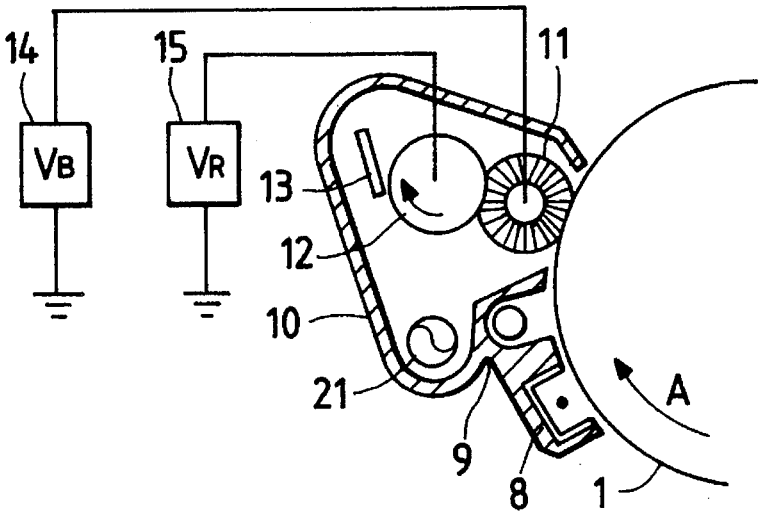
FIG. 7 is a cross sectional view showing a unique construction of the combination of charge supply unit, light erasing unit and bias cleaning unit according to still another embodiment of the present invention.

Assembling the charge supply unit 8 and the light erasing unit 9 into a single unit will reduce the size of the machine and provide for easy maintenance. Moreover assembling the charge supply unit 8, the light erasing unit 9, and the bias cleaning unit 10 into a single unit as shown in FIG. 7 will further reduce the machine size.

FIG. 3 is a sectional view showing a bias cleaning unit 10 according to another embodiment of the present invention. In the instant bias cleaning unit, the collecting roller 12 is located upstream of the conductive cleaning member 11 when viewed in the direction in which the photoreceptor rotates, in a state that the collecting roller 12 is brought in contact with or in close proximity to the photoreceptor 1. This bias cleaning unit is advantageous in that the collecting roller 12 not only assists the operation of cleaning the photoreceptor 1, but also collects toner falling with the rotation of the conductive cleaning member 11.

Figure 4:
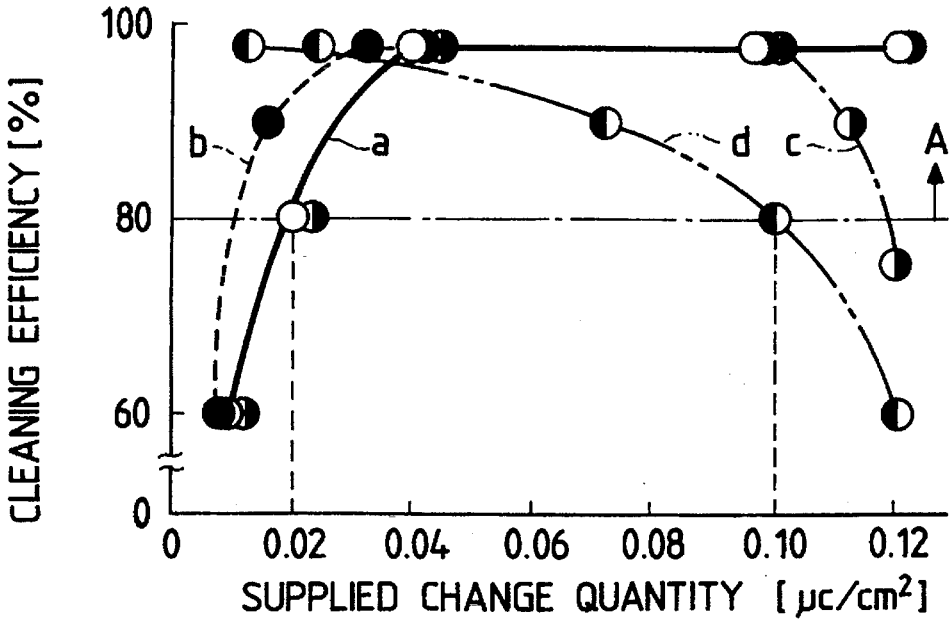
FIG. 4 is a graph showing a variation of the residual toner cleaning efficiency with respect to the quantity of supplied charge.

FIG. 4 is a graph showing a variation of the residual toner cleaning efficiency with respect to the quantity of supplied charge. In the graph, a line a shows the cleaning characteristic of normal residual toner; b, the cleaning characteristic of fog residual toner; c, the cleaning characteristic of jam residual toner; and d, the cleaning characteristic of power-supply-failure residual toner. The cleaning efficiency is defined as y/x where x is the quantity of residual toner after having passed the bias cleaning unit 10 and y is the quantity of residual toner resulting from the residual toner after having passed the transfer unit 5 being subtracted from the value of x. An area where the cleaning efficiency is 80% or more is denoted as A. As seen from FIG. 4, the quantities of the supplied residual toner a, b, c, and d are different in the area A. In order that the quantities of the supplied residual toner a, b, c, and d are all contained in the area A, the charge supply must be made such that the absolute value of the DC component is within 0.02 to 0.1 $\mu C/cm^2$. Where the cleaning is made only for the residual toner a and b, selection of the absolute value of the DC component within 0.02 to 0.2 $\mu C/cm^2$ will suffice, although not shown. For the system in which a lower cleaning efficiency is allowed, the absolute value of the DC component may be set within the range of 0.01 to 0.2 $\mu C/cm^2$, although not shown.

Figure 5:
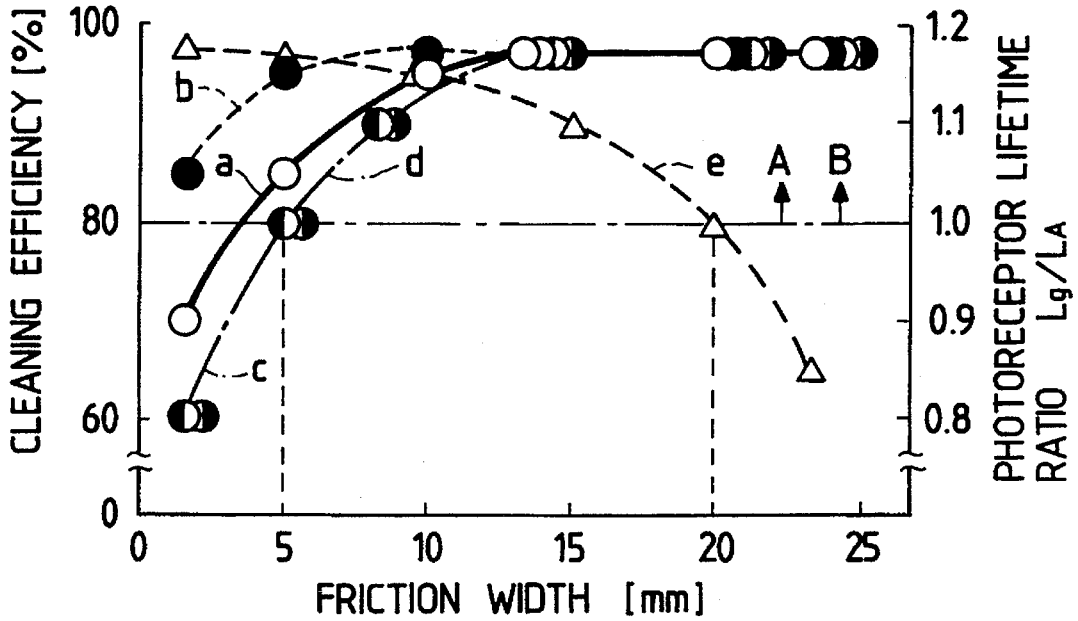
FIG. 5 is a graph showing the relationship among the cleaning efficiency, friction width of the photoreceptor and the conductive cleaning member, and the lifetime of the photoreceptor.

FIG. 5 is a graph showing the relationship among the residual toner cleaning efficiency, friction width of the photoreceptor and the conductive cleaning member, and the lifetime of the photoreceptor. Reference characters a, b, c, d and A indicate the same meanings as those in FIG. 4. The character e indicates a ratio of the photoreceptor lifetime LB and the specification value LA of the photoreceptor lifetime when the friction width is varied. The character B indicates an area where $LB/LA \geqq 1$. This area is an optimum area when considered in light of the lifetime of the photoreceptor. As seen from FIG. 5, the cleaning efficiency increases more as the friction width increases. However, the lifetime of the photoreceptor becomes shorter since the photoreceptor becomes much more worn owing to its rubbing with the conductive cleaning member. Therefore, an optimum value of the friction width is within 5 to 20 mm where the quantities of the supplied residual toner a, b, c, and d are all contained in both the areas A and B.

Figure 6:
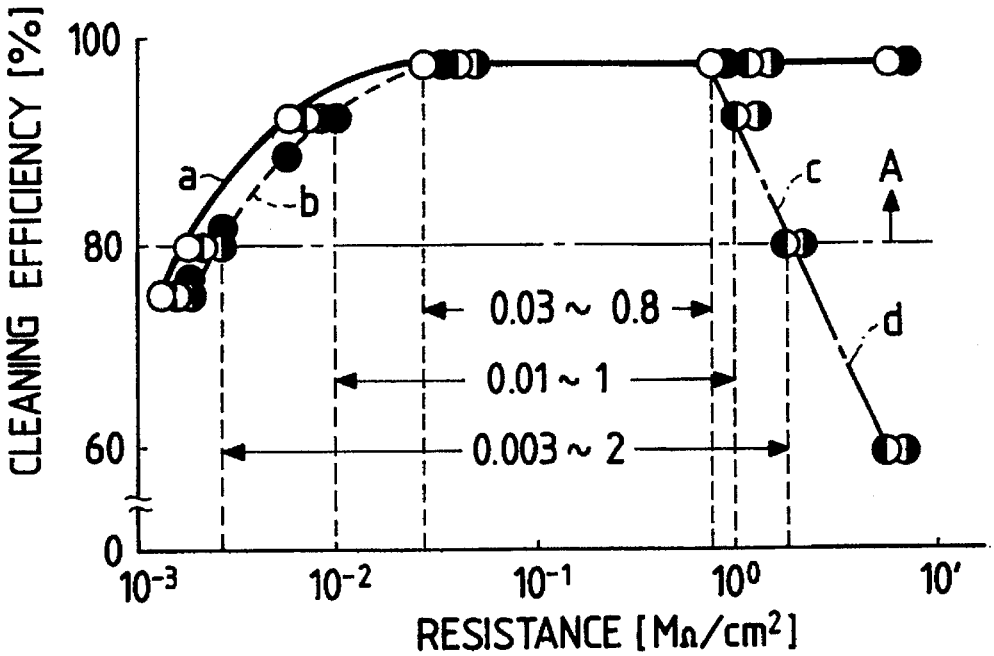
FIG. 6 is a graph showing a variation of the cleaning efficiency with respect to resistance of the conductive cleaning member.

FIG. 6 is a graph showing a variation of the cleaning efficiency with respect to resistance of the conductive cleaning member. Reference characters a, b, c, and d and A indicate the same meanings as those in FIGS. 4 and 5. As seen from FIG. 6, the cleaning efficiency varies depending on the resistance. Assuming that the area denoted as A is an optimum area, a range of 0.003 to 2 $M\Omega/cm^2$ is preferable as a value of the result of dividing a value of resistance between the collecting roller and the conductive cleaning member by the friction area between them. A range of 0.01 to 1 $M\Omega/cm^2$ is preferable since this range provides a less reduction of the cleaning efficiency. A range of 0.03 to 0.8 $M\Omega/cm^2$ is more preferable since this range provides little reduction of the cleaning efficiency.

The experiment by which the data shown in FIGS. 4 to 6 are gathered was conducted under the following conditions:

Peripheral speed of the photoreceptor: 250 mm/s

Toner charge quantity: 15 to 25 $\mu C/g$

Conductive cleaning member material (brush): Fiber made of resin such as acetate or polyamide containing carbon dispersed therein, or fiber containing a carbon layer in the resin.

Number of revolutions of the conductive cleaning member per minute: 135 rpm

Substantially the same results were obtained under the conditions:

Peripheral speed of the photoreceptor: 100 and 400 mm/s

Toner charge quantity: 10 to 20 $\mu C/g$

Number of revolutions of the conductive cleaning member per minute: 50 to 200 rpm As described above, the friction width of the conductive cleaning member, and the resistance of the conductive cleaning member and the collecting roller resulting from dividing the resistance by the friction area by the friction width therebetween is applied not only to the structure of the electrophotographic recording apparatus shown in FIG. 1. For example, it is also applied to a bias cleaning apparatus of the electrophotographic recording apparatus without a charge supply means and a light erasing means. Further, it is also applied to a bias cleaning apparatus in which an object to be cleaned is not a photoreceptor but an intermediate transfer medium or a transfer belt.

As described above, an electrophotograpic recording apparatus using the bias cleaning method according to the present invention is constructed such that the charge supply unit and light erasing unit are disposed between the transfer unit and the bias cleaning unit, and erasing light is projected onto a photoreceptor surface area except the charge supplied area. With such a construction, the residual toner on the surface of the photoreceptor can be removed efficiently. There is successfully eliminated such a disadvantage that toner left as the result of insufficient cleaning attaches to the image receiving member, such as paper, in the subsequent cycle.

The optimum values of the current fed to the photoreceptor, the friction width of the conductive cleaning member and the photoreceptor, and the resistance of the conductive cleaning member and the collecting roller (result of dividing the resistance by the friction area between them) are empirically obtained. Therefore, a stable cleaning performance can be kept without reducing the lifetime of the photoreceptor. In the system using again the collected toner, the toner charging time in the developing unit can be reduced.

Now, another aspect of the present invention will be described with reference to FIGS. 8 to 31.

Figure 8:
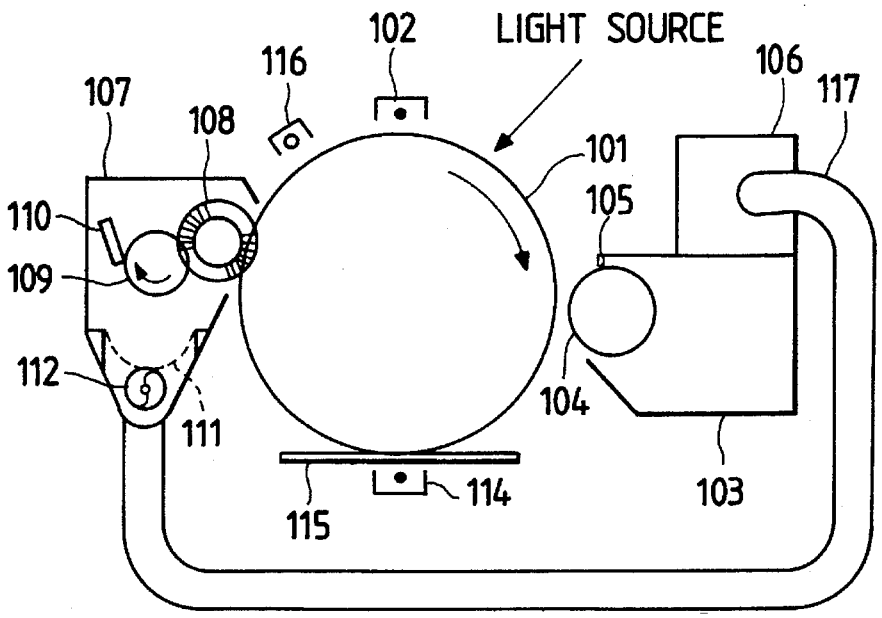
FIG. 8 is an explanatory diagram showing a photoreceptor using a developing device and components disposed around the photoreceptor.

FIG. 8 is an explanatory diagram showing a photoreceptor using a developing device and components disposed around the photoreceptor.

In the figure, reference numeral 101 designates a photoreceptor; 102, a charger; 103, a developing unit including a magnet roll 104, a doctor blade 105 and a toner hopper 106; 107, a cleaner section including a brush 108, a collecting roll 109, a blade 110, a foreign material collector 111, and a toner transport screw 112; 114, a transfer unit; 115, a paper; and 116, an eraser.

In the present invention, the toner hopper 106 is coupled with the cleaner section 107 by a toner transport pipe 117. The developing unit 103 and the cleaner section 107 make up a developing apparatus.

With such a construction, the charger 102 carries out a corona discharge to charge the photoreceptor 101. Through the exposure process, a latent image is formed on the photoreceptor 101. In the developing unit 103, a developer on the magnet roll 104 is properly regulated in quantity by a doctor blade 105. When the photoreceptor 101 passes in front of the magnet roll 104, toner is attached to the latent image, thereby developing the latent image.

Thereafter, the toner is attracted from the photoreceptor 101 to the paper 115 by the transfer unit 114, such as a corotron. The residual toner of the opposite polarity, for example, left on the photoreceptor 101, is removed in the cleaner section 107. The surface of the photoreceptor 101 is discharged by the eraser 116, such as an erase lamp, and ready for the copying operation of the second cycle.

In the cleaner section 107, the conductive brush 108 applied with a voltage attracts the toner. The toner is transferred to the collecting roll 109 set at a high voltage. The toner is scraped away off the collecting roll 109 by the blade 110, and drops into the foreign material collector 111. Then, it is transported outside the cleaner section by the toner transport screw 112.

Thereafter, the toner passes through the toner transport pipe 117 and then returns to the toner hopper 6 or a developer bath, and is used again.

With such a construction, foreign materials contained in the collected toner are removed by the foreign material collector 111, while repeating the collection/reuse of toner. The toner, which is free of foreign materials, is used again for development.

Figure 9:
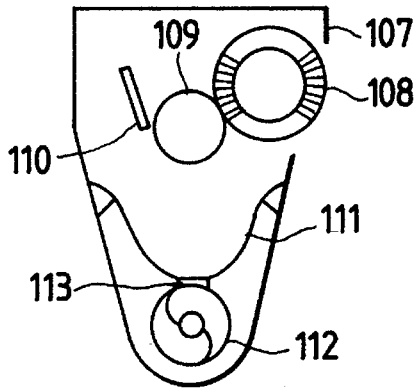
FIG. 9 is a sectional view showing a cleaner section containing a foreign material collector.
Figure 10:
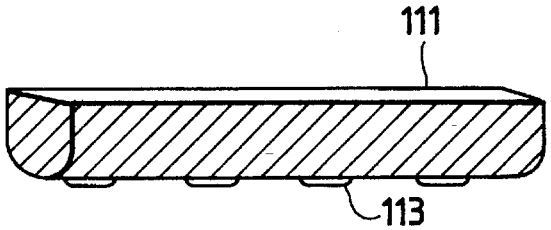
FIG. 10 is a perspective view showing the foreign material collector.
Figure 11:
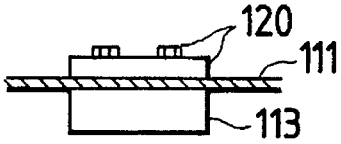
FIG. 11 is a side view showing the structure of a key portion of the foreign material collector.

FIG. 9 is a view showing a cleaner section containing a foreign material collector. FIG. 10 is a perspective view showing the foreign material collector. FIG. 11 is a view showing the structure of a key portion of the foreign material collector.

The foreign material collector 111 uses a net. The net of 0.5 to 3.0 mm square in mesh is made of polyamide imide, acetate or the like. The mesh of this size allows paper particles, paper fabrics and the like as well as the toner to pass therethrough smoothly.

The net is shaped such that the top thereof is open and the cross section thereof is shaped like U, as shown in FIG. 10. The net is set in a state that it is buried in the toner. Plate- or bar-like vibrating members 113 are mounted on the bottom of the net by means of mounting pieces 120 at regular or irregular intervals. The vibrating members 113 each comes in contact with the top of the toner transport screw 112.

Figure 12:
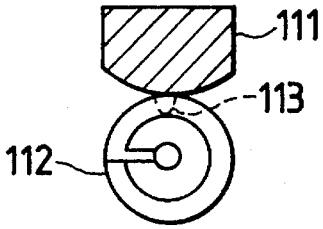
FIG. 12 is a side view showing the vibrating mechanism of a foreign material collector according to still another embodiment of the present invention.
Figure 13:
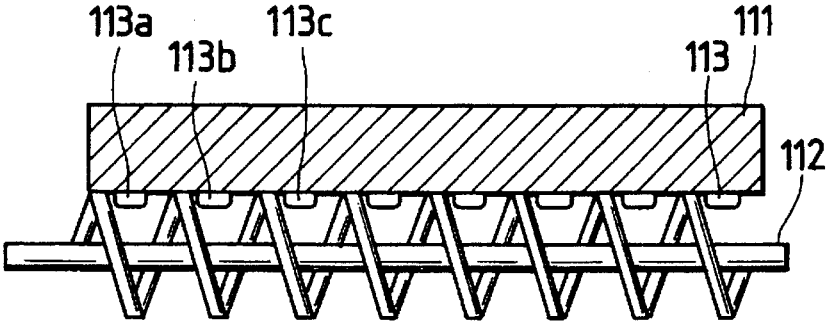
FIG. 13 is a front view of the vibrating mechanism shown in FIG. 5.

FIG. 12 is a side view showing the vibrating mechanism of a foreign material collector according to another embodiment of the present invention. FIG. 13 is a front view of the vibrating mechanism shown in FIG. 12.

In this embodiment, when the toner transport screw 112 turns, vibrating members 113*a*, 113*b*, and 113*c* mounted at regular intervals simultaneously come in contact with the top of the toner transport screw 112. When the toner transport screw 112 further turns, those members are positioned above the bottom of the toner transport screw 112.

Thus, the vibrating members 113 are vibrated vertically repeatedly with rotation of the toner transport screw 112. With the vibration, paper particles and fibers cling to one another and attract other foreign materials, thereby forming clumps larger than the mesh size. As a result, those clumps of foreign materials are caught by the net.

The net is vibrated by the rotation of the toner transport screw 112, even if the vibrating members 113 are not used. The toner transport screw 112, which is constructed with a spring-like member having no shaft and vibrating by itself, vibrates the net more greatly than the toner transport screw 112 having the shaft. In this case, there is no need of using the vibrating members 113.

In this embodiment, the brush cleaner is used. However, the foreign material collector is likewise applicable for another cleaner, such as a blade cleaner.

Figure 14:
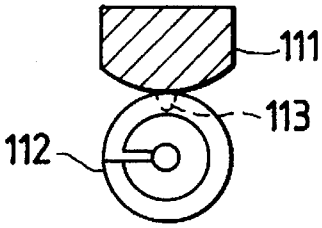
FIG. 14 is a side view showing the vibrating mechanism of a foreign material collector according to still another embodiment of the present invention.
Figure 15:
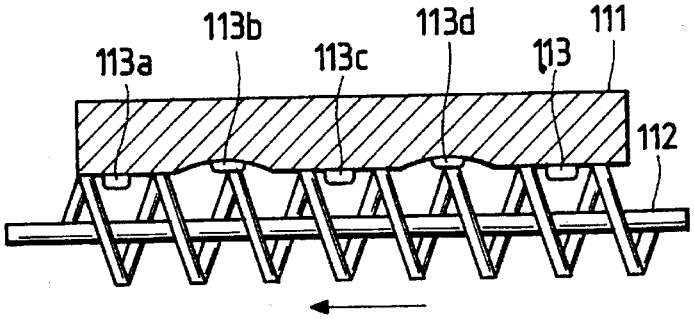
FIG. 15 is a front view of the vibrating mechanism shown in FIG. 14.

FIG. 14 is a side view showing the vibrating mechanism of a foreign material collector according to still another embodiment of the present invention. FIG. 15 is a front view of the vibrating mechanism shown in FIG. 14.

In this embodiment, all the vibrating members 113 are not simultaneously brought into contact with the toner transport screw 112. Let us consider the operation of this embodiment in the particular stages. When the vibrating members 113*a* and 113*c*, for example, are brought in contact with the top of the toner transport screw 112, the vibrating member 113*b* is positioned above the bottom of the toner transport screw 112. The vibrating members 113*a*, 113*b*, 113*c*, and 113*d* undergoes a similar state in successive manner. In this embodiment, a more complicated vibration occurs in the foreign material collector 111.

Figure 16:
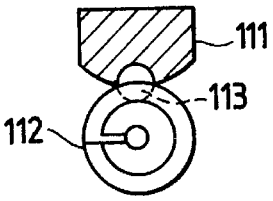
FIG. 16 is a side view showing the vibrating mechanism of a foreign material collector according to still another embodiment of the present invention.
Figure 17:
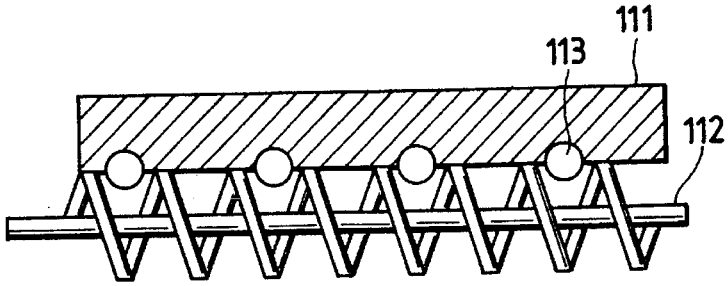
FIG. 17 is a front view of the vibrating mechanism shown in FIG. 16.

FIG. 16 is a side view showing the vibrating mechanism of a foreign material collector according to still another embodiment of the present invention. FIG. 17 is a front view of the vibrating mechanism shown in FIG. 16.

In this embodiment, each of the vibrating members 113 are spherical in shape. This embodiment can achieve the useful effects similarly to the former two embodiments already described. The vibrating member 113 for vibrating the foreign material collector 111 may take any shape, for example, a single or a plural number of bars.

Figure 18:
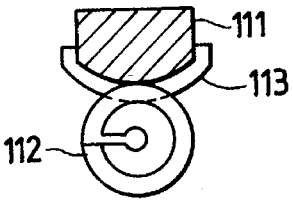
FIG. 18 is a side view showing the vibrating mechanism of a foreign material collector according to still another embodiment of the present invention.
Figure 19:
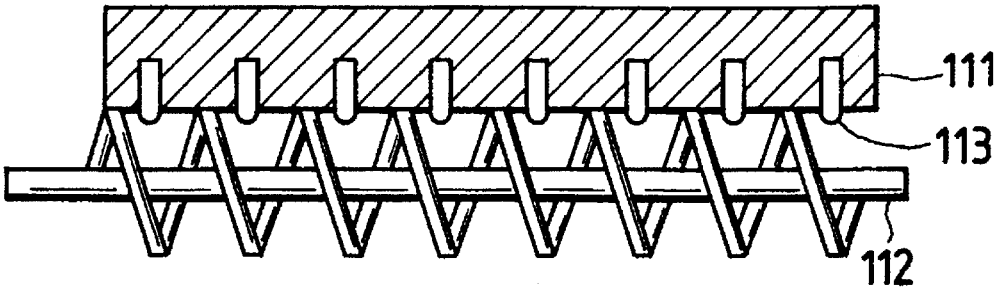
FIG. 19 is a front view of the vibrating mechanism shown in FIG. 18.

FIG. 18 is a side view showing the vibrating mechanism of a foreign material collector according to still further embodiment of the present invention. FIG. 19 is a front view of the vibrating mechanism shown in FIG. 18.

This embodiment is different from the previously mentioned embodiments shown in FIGS. 12 and 14 in that the vibrating members 113 are mounted on the foreign material collector 111 in the direction orthogonal to the apparent traveling direction of the toner transport screw 112.

When the toner transport screw 112 travels, the vibrating members 113 are fed in the same direction since it is pushed by the toner transport screw 112. When the toner transport screw 112 travels a preset distance, the vibrating members 113 get over the toner transport screw 112 to be set at their home positions. Repeating this process causes a vibration in the foreign material collector 111.

Figure 20:
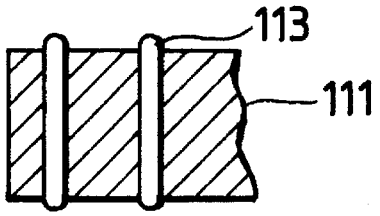
FIG. 20 is a bottom view of a key portion of the foreign material collector shown in FIG. 18.
Figure 21:
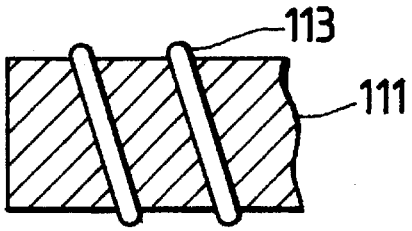
FIG. 21 is a bottom view of a modification of the foreign material collector shown in FIG. 20.

FIG. 20 is a bottom view of a key portion of the foreign material collector shown in FIG. 18. FIG. 21 is a bottom view of a modification of the foreign material collector shown in FIG. 20.

In the embodiment of FIG. 20, the vibrating members 113 are disposed at a right angle to the longitudinal direction of the foreign material collector 111. In the modification of FIG. 21, the vibrating members 113 are mounted on the foreign material collector 111 in a state that it is oblique to the apparent traveling direction of the toner transport screw 112. Those embodiments are also operated as the above-mentioned embodiments of FIGS. 12 and 14. In the case of FIG. 21, the vibrating members 113 are more easily brought into contact with the toner transport screw 112 since the vibrating members 113 are oblique to the toner transport screw 112.

Figure 22:
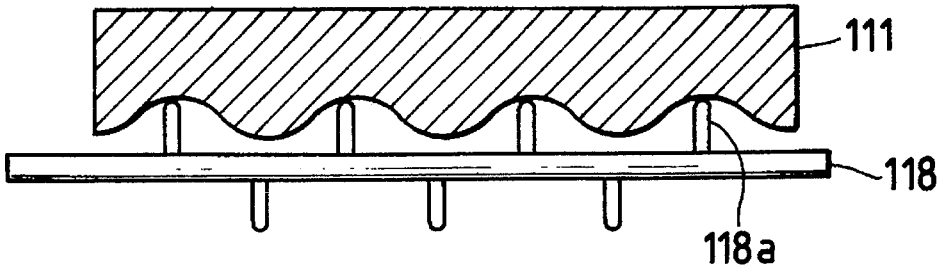
FIG. 22 is a front view showing the vibrating mechanism of a foreign material collector according to still another embodiment of the present invention.

FIG. 22 is a front view showing the vibrating mechanism of a foreign material collector according to still another embodiment of the present invention.

In this embodiment, the vibrating member of the foreign material collector 11 is provided separately from the net. In the figure, the bottom of the net is pushed at several locations with branch-like protruded parts 118*a* of the rotary member 118 when the protruded parts 118*a* turn in the upper space with the rotation of the rotary member 118. The net bottom moves down when the protruded parts 118*a* turn in the lower space. Repeating this cycle, the net is vibrated. The arrangement of the protruded parts 118*a* mounted on the rotary member 118 are not always symmetrical with respect to the rotary shaft.

Figure 23:
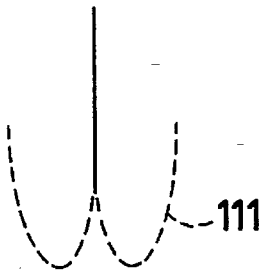
FIG. 23 is a side view showing the vibrating mechanism of a foreign material collector according to a still another embodiment of the present invention.
Figure 24:
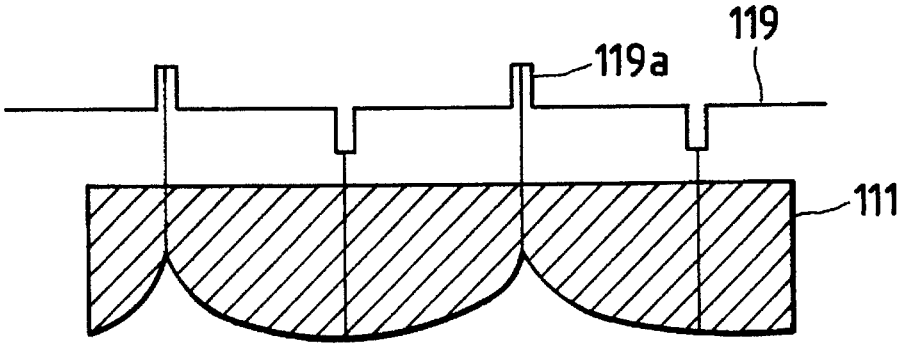
FIG. 24 is a front view of the vibrating mechanism shown in FIG. 23.

FIG. 23 is a side view showing the vibrating mechanism of a foreign material collector according to still another embodiment of the present invention. FIG. 24 is a front view of the vibrating mechanism shown in FIG. 23.

Also in this embodiment, a rotary member 119 is provided separately from the net, as in the embodiment FIG. 22.

The bottom of the net is coupled at several locations with the rotary member 119 like a crank. When some of the protruded parts 119*a* turn in the upper space with rotation of the rotary member 119, the bottom of the net is pulled up. When the protruded parts 119*a* turns in the lower space, the net bottom drops. Repeating this cycle, the net is vibrated.

Figure 25:
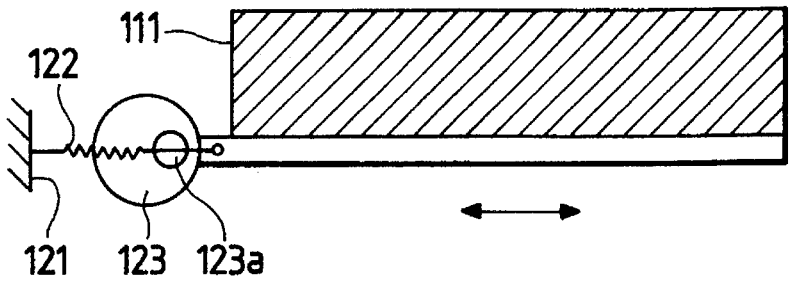
FIG. 25 is a front view showing the vibrating mechanism of a foreign material collector according to still another embodiment of the present invention.

FIG. 25 is a front view showing the vibrating mechanism of a foreign material collector according to still another embodiment of the present invention.

In the figure, reference numeral 121 designates a fixed wall. A tension spring 122 is secured at one end to the fixed wall 121 and at the other end to one end of the foreign material collector 111. Art eccentric cam 123 rotates about the shaft 123*a* thereof, while constantly contacting with one end of the foreign material collector 111.

With such a construction, when the eccentric cam 123 is turned, the foreign material collector 111 is moved to the right as viewed in the drawing while resisting the tensile force of the tension spring 122 or moved to the left by the tensile force thereof.

Thus, the foreign material collector 111 is moved to the right and left repeatedly, with the rotation of the eccentric cam 123.

Figure 26:
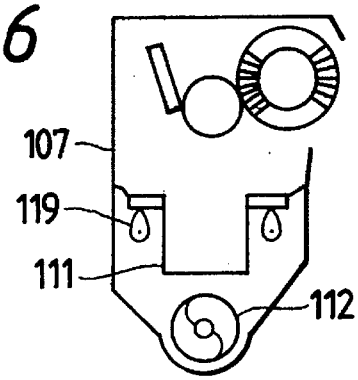
FIG. 26 is a diagram showing the construction of a cleaner section provided with a foreign material collector according to still another embodiment.
Figure 27:
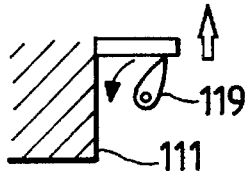
FIG. 27 is a diagram showing a key portion of the cleaner section where the foreign material collector is in a raised state.
Figure 28:
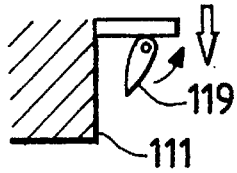
FIG. 28 is a diagram showing the key portion of the cleaner section where the foreign material collector is in a lowered state.

FIG. 26 is a diagram showing the construction of a cleaner section provided with a foreign material collector according to still another embodiment. FIG. 27 is a diagram showing a key portion of the cleaner section where the foreign material collector is in a raised state. FIG. 28 is a diagram showing the key portion of the cleaner section where the foreign material collector is in a lowered state.

In the figure, reference numeral 119 denotes vibration gears 119, which allows the net to be raised (FIG. 27) and to be lowered (FIG. 28) during a counterclockwise rotation of vibration gears 119.

Figure 29:
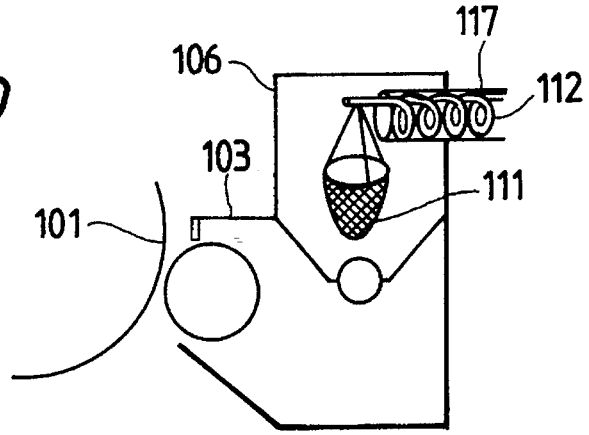
FIG. 29 is a diagram showing an example of the construction of a developing apparatus with a foreign material collector.
Figure 30:
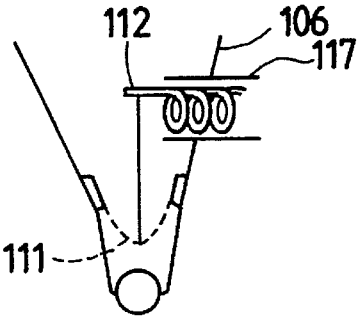
FIG. 30 is a diagram showing another example of the construction of a key portion of a developing apparatus with a foreign material collector.

FIG. 29 is a diagram showing the construction of an example of a developing apparatus with a foreign material collector. FIG. 30 is a diagram showing the construction of a key portion of another example of a developing apparatus with a foreign material collector.

Toner collected by the cleaner section 107 is transported toward a developing unit 103 by a transporting unit. The collected toner is returned through a toner transport pipe 117 to a toner hopper 106. A foreign material collector 111 of a bag-like net is coupled with the fore end of the toner transport pipe 117. The net is moved up and down by a toner transport screw 112. The collected toner, together with fresh toner, is put into the net. Under the vibration, foreign materials cling to one another, to form clumps. Those clumps of foreign materials are caught by the net. The toner free of foreign materials is supplied to the developing unit 103.

The developing apparatus thus constructed can catch foreign materials contained in the supplied toner in the toner hopper 106 as well as the foreign materials in the collected toner.

Figure 31:
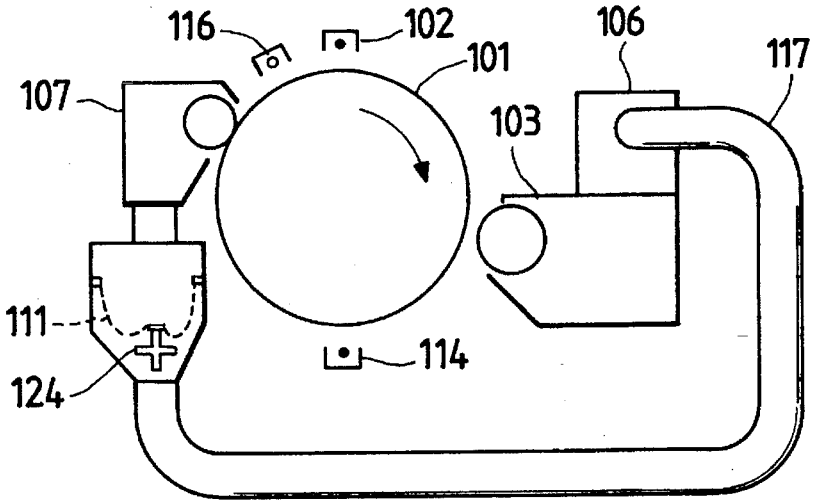
FIG. 31 is a diagram showing a developing apparatus in which a foreign material collector is provided between a cleaner section and a developing unit.

FIG. 31 is a diagram showing a developing apparatus in which a foreign material collector is provided between a cleaner section and a developing unit.

The foreign material collector 111 is removably set in the lower portion of the cleaner section 107 so that it is vibrated by a vibration gear 124.

The foreign material collector may be swung in such a manner as the above-mentioned embodiments. In this embodiment, when a saturated amount of foreign materials is reached, the unit containing the foreign material collector may be replaced with a new one.

As described, foreign materials contained in the collected toner, when vibrated by the net-like foreign material collector, cling together into clumps. The clumps of foreign materials are caught. Therefore, the developing apparatus of the invention succeeds in solving such problems as poor print caused by foreign materials caught on the toner regulating member, and reduction of the charge quantity of the developer within the developing unit and reduction of the fluidity of developer, which result from the mixing of foreign material into the toner.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electrophotographic recording apparatus comprising:

a photoreceptor for forming a toner image on a surface thereof and which rotates in a given direction;

image receiving means;

transfer means for transferring the toner image on said photoreceptor onto said image receiving means;

bias cleaning means including a conductive cleaning member applied with a voltage for removing toner left on the surface of said photoreceptor, in which a friction width of said conductive cleaning member and said photoreceptor during the process of cleaning said photoreceptor is 5 to 20 mm;

a collecting roller for collecting toner attached to said conductive cleaning member, said collecting roller being applied with a high voltage from said conductive cleaning member;

charge supply means for supplying charge to the surface of said photoreceptor; and light erasing means for projecting light onto the surface of said photoreceptor;

wherein said charge supply means and said light erasing means are disposed between said transfer means and said bias cleaning means in the stated order when viewed in the given direction of photoreceptor rotation, and said light erasing means projects erasing light onto an area of the surface of said photoreceptor except for an area to which the charge is supplied, wherein the absolute value of a DC component of a current that is fed to said photoreceptor by said charge supply means is 0.01 to 0.2 $\mu C/cm^2$, and further wherein a value resulting from dividing a resistance value between said conductive cleaning member and said collecting roller during the process of cleaning said photoreceptor by a friction width is 0.003 to 2 $M\Omega/cm^2$.

2. An electrophotographic recording apparatus according to claim 1, further comprising transport means connected between said bias cleaning means and a developing means, to reuse toner collected by said collecting roller for development, wherein charges before cleaning have the same polarity as toners in development.

3. An electrophotograpic recording apparatus according to claim 1, further comprising transport means connected between said bias cleaning means and a developing means, to reuse toner collected by said collecting roller for development.

4. A developing apparatus according to claim 3, further comprising a mesh-shaped foreign material collector operative to vibrate so as to remove foreign material contained in toner, which is disposed at a position in a residual toner restoring path passing through said bias cleaning means, said transport means and said developing means.

5. A developing apparatus, comprising:

a photoreceptor for forming a toner image on a surface thereof;

cleaner means for removing and collecting residual toner on said photoreceptor;

a toner transport pipe;

developing means including a toner hopper which is coupled with said cleaner means through said toner transport pipe;

a foreign material collector for collecting foreign material and disposed at a predetermined location in a residual toner collecting path ranging through said cleaner means, said toner transport pipe, and said toner hopper, said foreign material collector being meshed and having openings larger than a size of the foreign material; and means for vibrating said foreign material collector.

6. A developing apparatus according to claim 5, in which said vibrating means comprises a toner transport screw and a vibrating member attached to said meshed foreign material collector, said vibrating member being vibrated when said vibrating member is brought in contact with said toner transport screw.

* * * * *